US005507066A

United States Patent [19]

Zulick

[11] Patent Number: 5,507,066

[45] Date of Patent: Apr. 16, 1996

[54] SUPPORT DEVICE FOR THE CYLINDRICAL HANDLE OF A PAINT ROLLER

[75] Inventor: Tadeck Zulick, Charleville-Mezieres, France

[73] Assignee: ETS Ridremont Brosserie, Renwez, France

[21] Appl. No.: 287,085

[22] Filed: Aug. 8, 1994

[30] Foreign Application Priority Data

Aug. 6, 1993 [FR] France ..... 93 09847
Mar. 4, 1994 [EP] European Pat. Off. ..... 94440015

[51] Int. Cl.[6] ..... B05C 17/02

[52] U.S. Cl. ..... 15/230.11; 15/143.1; 15/144.1; 492/13; D4/122

[58] Field of Search ..... 15/143.1, 144.1, 15/144.3, 230.11; 492/13, 14; D4/122, 123

[56] References Cited

U.S. PATENT DOCUMENTS

| | | | |
|---|---|---|---|
| 698,849 | 4/1902 | Ouellette | 15/143.1 |
| 2,021,158 | 11/1935 | Stearns | 15/144.1 |
| 2,529,399 | 11/1950 | Kruck | 15/144.1 |
| 2,542,774 | 2/1951 | Hutchinson | 15/230.11 |
| 3,386,124 | 6/1968 | Feine | 15/230.11 |
| 4,593,428 | 6/1986 | Calvert | 15/248.2 |
| 4,850,074 | 7/1989 | Klevan | 15/144.1 |
| 4,899,417 | 2/1990 | Schaffer et al. | 15/230.11 |

FOREIGN PATENT DOCUMENTS

| | | | |
|---|---|---|---|
| 404722 | 12/1909 | France | 15/144.1 |
| 1457903 | 11/1966 | France . | |
| 7676 | of 1884 | United Kingdom | 15/144.1 |
| 700733 | 12/1953 | United Kingdom | 15/230.11 |

*Primary Examiner*—Mark Spisich
*Attorney, Agent, or Firm*—Weintraub DuRoss & Brady

[57] ABSTRACT

A support device for the mechanical handle of a paint roller. This support, made by molding of a plastic material, comprises a handle divided lengthwise in two parts joinable together by a locking mechanism. The handle is articulated on a stirrup which supports the cylindrical handle, and which is able to rotate to 90 degrees, from a position parallel to the stirrup to a position perpendicular to the stirrup. The parts of the handle articulate themselves on the stirrup by the intermediary of molded bridges on a stud projecting centrally from the stirrup.

9 Claims, 2 Drawing Sheets

SUPPORT DEVICE FOR THE CYLINDRICAL HANDLE OF A PAINT ROLLER

BACKGROUND OF THE INVENTION

1. Field of the Invention

The present invention relates to a support device for the cylindrical handle of a paint roller.

2. Prior Art

Present day known paint rollers usually present a T-form and comprise a cylindrical handle mounted in free rotation between the cheeks on a stirrup. The rollers are generally a bent metal wire fitted at its end with a handle. These rollers are very cumbersome, notably when they are offered for sale on a display where they are generally suspended from a rod by an opening provided at the end of the handle.

The present invention aims to remedy this disadvantage by proposing a support for paint rollers which, over and above being of a greatly reduced incumbrance when exhibited for sale, likewise presents the advantage of being of a lower cost of manufacture and weighing less than existing devices.

SUMMARY OF THE INVENTION

The support device for a paint roller according to the invention is essentially characterized in that it is manufactured entirely from injection molding of a plastic material. The handle is divided lengthwise in two joinable parts, articulated on the part or stirrup intended to support the cylindrical handle.

Such a support can likewise be presented for sale with the two joinable parts of the handle in their prolongation state the length of the stirrup being intended to support the cylindrical handle parallel to the stirrup. This permits an important saving place on the display.

To utilize such a roller, one needs only to bring the two parts of the handle together and lock them one into the other, their joining be realized by means known, per se.

The advantages and the characteristics of the present invention will be more clearly evident from the following description, made with reference to the annexed drawing, which represents non-limititive embodiments.

DESCRIPTION OF THE DRAWING

FIG. 4 represents a front view of a second embodiment of a device according to the invention; and FIG. 5 represents a front view of the same invention in another configuration.

DESCRIPTION OF THE PREFERRED EMBODIMENT

Figure 1:
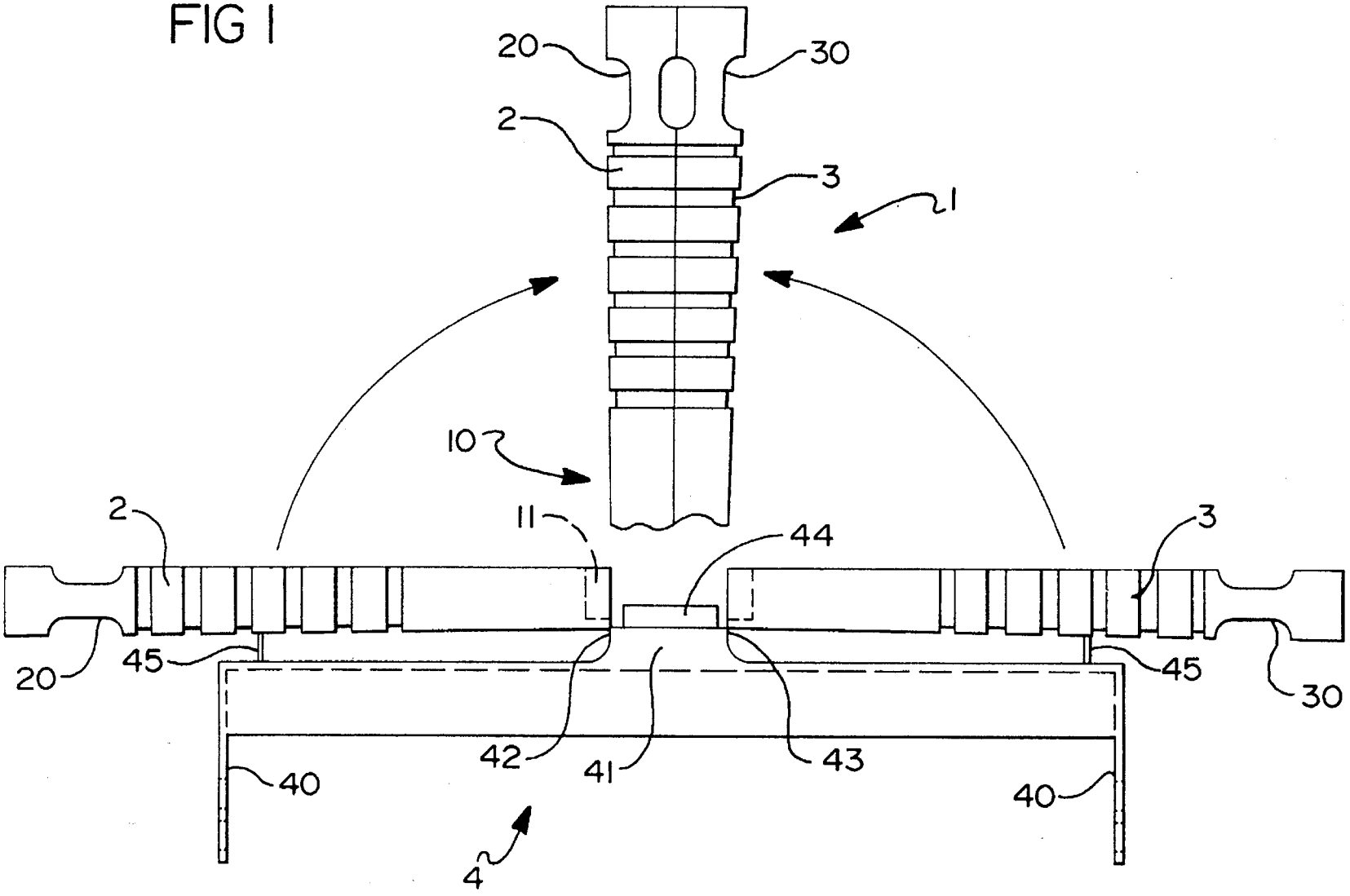
FIG. 1 represents a partial front view of a first embodiment of a device according to the invention, where the handle is in the two extreme positions, open and closed.
Figure 2:
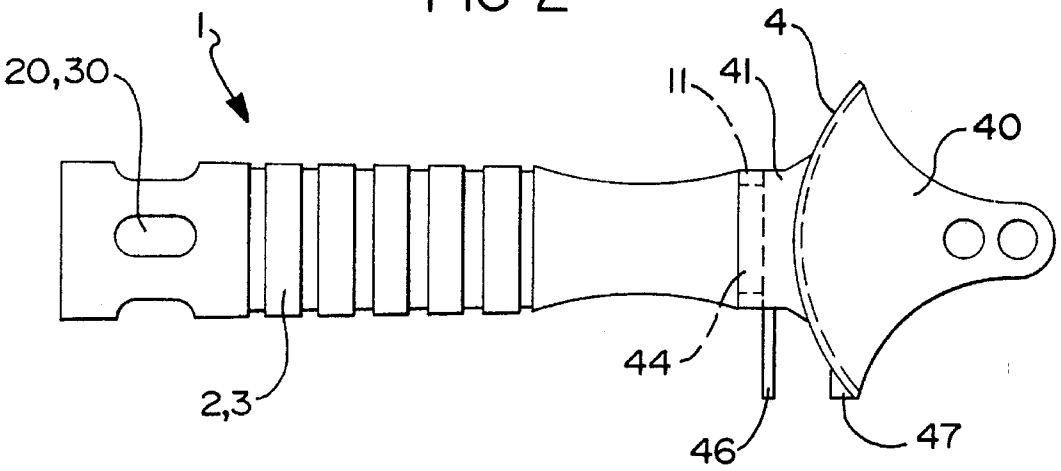
FIG. 2 represents a side view of the same device when the handle is reconstituted.
Figure 3:
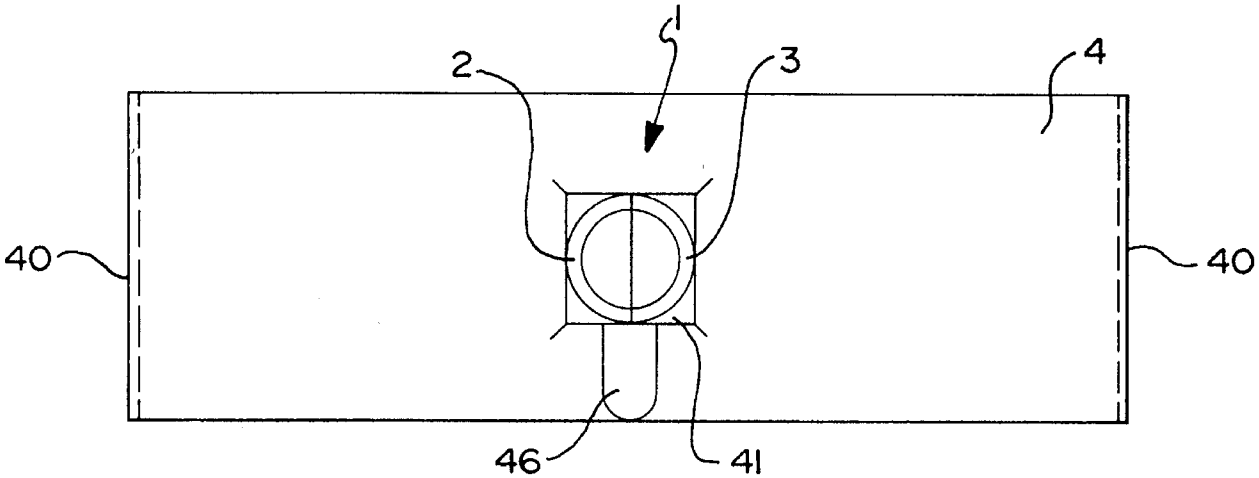
FIG. 3 represents an upper view, in the prolongation of the reconstituted handle of the same device.

Referring to FIGS. 1, 2 and 3 a cylindrical handle support for a paint roller device according to the invention manufactured by polypropylene-type plastic material injection molding, comprises two distinct parts, to wit, a handle 1, perceptively cylindrical, divided into half cylindrical parts 2 and 3, and a stirrup 4, in chute form, comprising at each of its extremities a cheek 40 equipped with means for fixation to a roller.

A roller 1 constituted by the bringing together of the two parts 2 and 3, comprises a base 10 of a squared section, housing a cavity 11 of a likewise squared form.

The parts 2 and 3 of the handle 1 are joined to the stirrup 4 by a squared stud 41 positioned at the center of the stirrup 4 through two bridges, respectively 42 and 43. The bridges are created during molding, and allow a 90 degree rotation of the parts 2 and 3. This allows them to pass from a position parallel to a position perpendicular to the stirrup 4 to constitute the handle 1. The joining of one to the other of the two parts 2 and 3 is realized by known locking means (not represented).

A second stud 44, of likewise squared section, protrudes from the center of the stud 41. The exterior dimensions of the stud 44 is equal to the interior dimensions of the cavity 11 of the handle 1. The stud 44 is tightly covered by the base 10 of the handle at the time of bringing together the two parts 2 and 3, thereby reinforcing the joining and the maintaining of the handle 1 on the stirrup 4.

After manufacture, the handle 1 is open, the parts 2 and 3 are positioned parallel to the stirrup 4; fastened to it by divisible bridges 45, such that the support can be presented for sale suspended in the display with less space required. The openings 20 and 30 for suspension purposes are at the extremity of the respective parts 2 and 3 of the handle 1.

Alternatively, the stirrup 4 may have protruding perpendicularly at one and the same time to the stirrup 4 and to the access of the handle 1, two parallel snugs 46 and 47 for by molding, and which permit the horizontal positioning of the roller on the edge of a paint can (not shown) in view of its drainage. The spacing of these two snugs 46 and 47 permits their locking on a can of standard thickness.

Referring now to FIGS. 4 and 5, according to a second embodiment hereof the handle 1 is constituted in two non-identical parts 2' and 3', joinable one to the other by any suitable locking means.

The parts 2' and 3' are joined at the stirrup 4, with the possibility for rotation, in the same manner as in the preceding embodiment, that is to say by two bridges, respectively 42 and 43.

The part 2' comprises, at its ends, a tubular section 21 permitting the adaptation of an extension piece (not represented) thereby facilitating painting from a distance, for example for painting a ceiling.

The parts 2' and 3' each comprise, at the proximity of the bridges, respectively 42 and 43, and perpendicularly to it, a flat nervure, respectively at 22 and 32, intended, at the time of joining the parts 2' and 3' to comprise the handle 1, being engaged in a slot 48 used, in the lengthwise sense, in the stud 41. The flat nervures 22 and 32, in association with the slot 48 permit the reinforcement of the joining of the handle 1 to the stirrup 4, in the sense that during utilization of the toiler (not shown) it is perpendicular to the flat nervures 22 and 32.

It is fitting to note that each of the two parts 2' and 3' can comprise several flat parallel nervures 22, 32 destined to be engaged in several parallel slots used in the stud 41.

In addition to the sale presentation hanging advantage, the device according to the invention presents other advantages.

On the one hand, in effect, the chute form of the stirrup 4 alleviates the paint projections on the handle 1 as well as on the hand of the user.

On the other hand the fact that the device according to the invention is entirely made from plastic material, it does non present electrocution risks to the user, as in the case of classic paint rollers when used proximate a source of current.

Having thus described the invention, what is claimed is:

1. A combined handle and support device for a paint roller, comprising:

(a) a stirrup supporting a handle, the stirrup configured to rotatably receive a roller on a first side of the stirrup;

(b) a first stud projecting upwardly from a second side of the stirrup;

(c) a plurality of bridges projecting upwardly from the stirrup and being disposed adjacent the first stud; and wherein the handle comprises (1) plastic separable parts joinable along a lengthwise axis, the parts being articulated on the stirrup, the parts being rotatable from a position parallel to the stirrup to a position normal thereto, and further wherein each of the separable parts are articulated on a respective one of the bridges.

2. The combination of claim 1 wherein the plastic separable parts of the handle each further comprise:

a base, the bases of the separable parts cooperating to define a hollow inner cavity upon the joining of the separable parts, and wherein the stirrup further comprises a second stud centrally projecting from the first stud, the second stud projecting into the cavity and having an exterior dimension substantially equal to the dimension of the cavity.

3. The combination of claim 1 which further comprises:

at least one snug formed on the first stud normal to the bridges;

and wherein the at least one snug provides means for attaching the device to a can.

4. The combination of claim 3 which further comprises:

a pair of spaced apart parallel snugs, the snugs being perpendicular to the stirrup.

5. The combination of claim 1 which further comprises:

means at one end of the handle opposite its attachment to the stirrup for attaching an extension handle.

6. The combination of claim 1 wherein the plastic separable parts of the handle each further include a base portion having a flat nervure configured to seat in a slot formed in the first stud upon joining the separable parts to form the handle.

7. A combined handle and support device for a paint roller, comprising:

(a) an elongated stirrup supporting a handle, the stirrup comprising first and second sides, the first side of the stirrup configured to receive a roller;

(b) a first stud projecting upwardly from the second side of the stirrup;

(c) a plurality of bridges projecting upwardly from the stirrup and disposed adjacent the first stud; and wherein the handle comprises separable elongated parts each connected to a respective one of the bridges wherein each of the separable elongated parts is adaptable to be oriented in two positions, a first position wherein they are parallel to the stirrup and a second position wherein they are normal thereto.

8. The combined handle and support device of claim 7 wherein the fist stud projects upwardly from a center of the stirrup.

9. The combined handle and support device of claim 8, wherein each of the separable elongated parts further comprises a flat nervure.

* * * * *